US006856097B2

(12) United States Patent
Onishi

(10) Patent No.: US 6,856,097 B2
(45) Date of Patent: Feb. 15, 2005

(54) HIGH VOLTAGE TYPE IMAGE DISPLAY APPARATUS

(75) Inventor: Tomoya Onishi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 10/375,193

(22) Filed: Feb. 28, 2003

(65) Prior Publication Data

US 2003/0168991 A1 Sep. 11, 2003

(30) Foreign Application Priority Data

Mar. 5, 2002 (JP) ..... 2002-058573
Feb. 18, 2003 (JP) ..... 2003-039804

(51) Int. Cl.[7] ..... G09G 3/10

(52) U.S. Cl. ..... 315/169.1; 315/169.4; 313/521; 313/497; 445/67

(58) Field of Search ..... 315/169.1–169.4, 315/168; 313/495–497, 521; 345/67, 84; 445/60, 67, 72

(56) References Cited

U.S. PATENT DOCUMENTS 6,147,445 A 11/2000 Jager et al. ..... 313/336
6,267,636 B1 7/2001 Onishi et al. ..... 445/6
6,379,211 B2 4/2002 Onishi et al. ..... 445/73
6,420,824 B1 * 7/2002 Abe et al. ..... 313/495
6,486,610 B2 11/2002 Kojima et al. ..... 315/169.3
6,509,691 B2 1/2003 Yamazaki et al. ..... 315/169.3
6,653,777 B1 * 11/2003 Onishi ..... 313/495
2002/0084997 A1 7/2002 Ohnishi ..... 345/211

FOREIGN PATENT DOCUMENTS

EP 1 035 559 A2 9/2000
EP 1 117 124 7/2001
EP 1 220 273 A1 7/2002
JP 2001-23553 1/2001
WO WO 94/18694 8/1994

* cited by examiner

*Primary Examiner*—Haissa Philogene
(74) *Attorney, Agent, or Firm*—Fitzpatrick, Cella, Harper & Scinto

(57) ABSTRACT

An image display apparatus comprises an electrode showing an electric potential defined to be high and an electrode showing an electric potential defined to be lower than the high electric potential, the electrodes being arranged vis-à-vis, at least one of the electrodes having a part showing a thickness of not less than 2 $\mu$m and a part located closest to the other electrode and showing a surface roughness of not more than 0.5 $\mu$m. With this arrangement, the image display apparatus can effectively suppress an electric discharge from taking place between electrodes and occurrence of a problem of broken wire.

16 Claims, 10 Drawing Sheets

PRIOR ART

HIGH VOLTAGE TYPE IMAGE DISPLAY APPARATUS

BACKGROUND OF THE INVENTION

1. Field of the Invention

This invention relates to an image display apparatus adapted to utilize electron beams such as a field emission display (FED).

2. Related Background Art

Research efforts have been and being paid for developing large image display apparatus utilizing a Braun tube (CRT) or some other device having an image displaying effect in order to meet the large demand for such displays. Large display apparatuses are by turn required to be thin and light weight. Additionally, they have to be manufactured at low cost. However, the CRT is designed to accelerate electrons by a high voltage and then deflect accelerated electrons in order to excite the fluorescent substance laid on a face plate. Therefore, the CRT theoretically has a significant length and hence it is difficult to obtain a thin and lightweight CRT. The inventors of the present invention have been engaged in the development of surface conduction electron-emitting devices and image display apparatus comprising surface conduction electron-emitting devices.

For example, the inventors have tried to apply a multi-electron-beam source as shown in FIG. 9 of the accompanying drawings. FIG. 9 is a perspective view of an image display apparatus realized by using a multi-electron-beam source.

Referring to FIG. 9, the image display apparatus comprises a cathode ray tube formed by arranging surface conduction electron-emitting devices 4001, row-directional wirings 4002 and column-directional wirings 4003, of which the row-directional wirings 4002 and the column-directional wirings 4003 are so disposed as to produce a passive matrix. The display additionally comprises an outer container bottom 4004 (which may also be referred to as rear plate) carrying the multi-electron-beam source 4002, a side wall 4005 (which may also be referred to as support frame or outer container frame) and a face plate 4006 having a fluorescent layer 4007 and a metal back 4008. The fluorescent layer 4007 of the face plate 4006 includes phosphors that are excited by electron beams to emit light and a black matrix adapted to suppress reflections of external light and prevent the different colors of the phosphors from mixing. A high voltage is applied to the fluorescent layer 4007 and the metal back 4008 by a high voltage source 4011. Thus, the fluorescent layer 4007 and the metal back 4008 operate as anode.

Appropriate electric signals are applied to the row-directional wirings 4002 and the column-directional wiring 4003 of the multi-electron-beam source having a passive matrix wiring arrangement in order to drive selected ones of the surface conduction electron-emitting devices so as to output electron beams in an intended way. For example, to drive the surface conduction electron-emitting devices of a row of the matrix, a selection voltage Vs is applied to the row-directional wiring 4002 of the selected row and non-selection voltage Vns is applied to the row-directional wirings 4002 of all the unselected rows. In synchronism with the above voltage applications, a drive voltage Ve is applied to the column-directional wiring 4003 in order to cause them to output electron beams. With this technique, a voltage of Ve-Vs is applied to the surface conduction electron-emitting devices of the selected row and a voltage of Ve-Vns is applied to the surface conduction electron-emitting devices of the unselected rows. Therefore, the devices of the selected row can be made to output respective electron beams with different intensities by selecting appropriate values for the voltages Ve, Vs and Vns and differentiating the drive voltages Ve that are applied to the respective column-directional wirings 4003. Since surface conduction electron-emitting device shows a high response speed, the time length during which a surface conduction electron-emitting device outputs an electron beam can be changed by changing the duration of application of the drive voltage Ve.

The electron beams output from the multi-electron-beam source 4001 as a result of application of voltages as described above then irradiate the metal back 4008, to which a high voltage Va is being applied, to excite some or all of the phosphors arranged there as targets. As a result, the phosphors that are irradiated with an electron beam emit light. Thus, the above described arrangement operates as image display apparatus when voltage signals are applied thereto as a function of a given piece of image information.

In short, as a high voltage (which may also be referred to as acceleration voltage or anode voltage) is applied to the metal back 4008 that is part of the anode electrode of an image display apparatus having the above described configuration in order to generate an electric field between the rear plate 4004 and the face plate 4006 and accelerate the electrons emitted from the electron beam source 4001, which by turn excite the phosphors and cause them to emit light, an image is formed on the display apparatus. Since the luminance of the image display apparatus heavily depends on the acceleration voltage, a high acceleration voltage is required in order to raise the luminance of the displayed image. On the other hand, in order to realize a thin image display apparatus, the thickness of the image display panel of the image display apparatus needs to be reduced. Then, the distance separating the rear plate 4004 and the face plate 4006 needs to be made very small. As a result, a considerably strong electric field is produced between the rear plate 4004 and the face plate 4006.

However, a display panel of the above described type is accompanied by the following problems.

FIG. 10 of the accompanying drawings is a schematic cross sectional view of the display panel of an image display apparatus of the type under consideration. The image display apparatus comprises a rear plate 2005 having an electron beam source 2002 and a face plate 2007 having an anode 2104 and an acceleration voltage Va is being applied to the anode 2104. Note that the anode 2104 is electrically insulated by the vacuum gap separating the face plate 2007 and the rear plate 2005 and the surfaces of the face plate 2007 and the rear plate 2005. The dimensions of the vacuum gap define the depth of the image display panel, while the length and the width of the surface of the face plate 2007 and those of the surface of the rear plate 2005 define the area and the width of the region of the image display panel that is not used for displaying an image. Therefore, it is highly desirable that all these dimensions show a small value. However, as these dimensions are reduced, the display shows large electric field strength if compared with a display whose corresponding dimensions are not so small when the same voltage is applied to the anode 2104. Then, the former display shows an increased electric discharge probability. An electric discharge can remarkably degrade the image quality of the images produced by the image display apparatus and hence is a serious problem particularly when the reliability of image display apparatus is to be improved.

Particularly, since the rear plate 2005 and the face plate 2007 are generally glass-made members and the electric insulation of the surface of a dielectric plate such as a glass plate is much poorer than that of a vacuum gap, it is very important to improve the withstand voltage of the surfaces of those plates that are made of glass.

Meanwhile, there are known image display apparatus comprising an electric potential defining electrode 2106 formed on the surface of the rear plate 2005 or the face plate 2007 where the anode 2104 is arranged as shown in FIG. 11. The electric potential defining electrode 2106 is arranged there in order to define the distribution of electric potential on that surface and limit the region that is subjected to an electric field. The electric potential of the electric potential defining electrode 2106 is lower than that of the anode 2104. For example, EP 1117124 discloses an image display apparatus comprising such an electrode. If there is a structure located outside the image region of an image display apparatus and subjected to an electric field (in other words, located in a space subjected to an electric field), the electric field can be concentrated there depending on the profile of the structure to eventually give rise to an electric discharge. This is the reason why such an electric potential defining electrode 2106 is formed there. The electric potential defining electrode 2106 is designed to define an electric potential lower than that of the anode so as to alleviate the intensity of the electric field existing outside of itself.

There is also known a technique of arranging a high voltage supply terminal 2107 on the rear plate 2005 as shown in FIG. 12 in order to feed the anode 2104 on the face plate 2007 with electricity. Since the electron beam source 2002 arranged on the rear plate 2005 accelerates electrons, the potential difference between the electron beam source 2002 and the anode can become very large. Then, there can arise a problem of electric discharge between the high voltage supply terminal 2107 and the electrode 2018 that is closest to the high voltage supply terminal 2107 among the electrodes located on the rear plate 2005.

The arrangement of an electrode arranged on the surface of the member where the region defined by the anode is located and having an electric potential lower than the electric potential of the anode gives rise to the following problems.

Firstly, if an electrode to which a high voltage is applied has a complex profile that may includes a projection, generally the electric field is concentrated there to consequently give rise to an electric discharge. Secondly, as an electric discharge takes place, the electrode can be destroyed by the discharge current and become no longer electrically conductive if partly. Then, there arises a part where the electric potential is not defined. Techniques that can be used to prevent the electrode from producing a complex surface profile include the use of a thin film process for preparing the electrode. Specific examples of such techniques include vacuum evaporation and sputtering. Electrodes prepared by means of such techniques are generally relatively thin. A thin electrode can easily be destroyed by electric discharge. On the other hand, if an electrode is prepared by using a thick film that is formed by way of a thin film process in order to prevent the electrode from being destroyed, the stress in the film can be raised during the thin film process. A thick film process such as a screen printing process may alternatively be used for preparing an electrode. However, an electrode prepared by using such a technique can have a coarse surface that shows undulations, which by turn can give rise to an electric discharge. Techniques for coating the insulating surface arranged between the electrode showing an electric potential that is defined to be equal to that of the anode and the electrode showing an electric potential that is defined to be low are also being developed. However, when the electrode showing a low electric potential is prepared by using a thick film process along with such a technique, there are occasions where the high resistance film does not connect the low potential electrode well due to the following reason. While it is preferable to prepare the high resistance film by using a thin film that is made as thin as possible from the viewpoint of reducing the power consumption rate, the low potential electrode requires a certain thickness so that it may satisfactorily define an electric potential. Then, the thickness of the high resistance film and that of the low potential electrode show a large difference to consequently give rise to a problem (defective coverage) in the region where the high resistance film covers the low potential electrode. Such a defective connection can also give rise to an electric discharge and hence improvements have been required to the technique of using a high resistance film.

SUMMARY OF THE INVENTION

In view of the above discussed circumstances, it is therefore the object of the present invention to provide an image display apparatus that can minimize the probability of electric discharge between the electrodes arranged in opposition to each other on the same plane, including the electrode whose electric potential is defined to be high and the electrode whose electric potential is defined to be lower than that of the former electrode, and is free from electric disconnection of either of the electrodes.

According to the invention, the above object is achieved by providing an image display apparatus comprising an electrode showing an electric potential defined to be high and an electrode showing an electric potential defined to be lower than the high electric potential, the electrodes being arranged vis-à-vis, at least one of the electrodes having a part showing a thickness of not less than 2 $\mu$m and a part located closest to the other electrode and showing a surface roughness of not more than 0.5 $\mu$m.

Thus, an image display apparatus according to the invention comprises a pair of electrodes at least one of which has a part whose thickness is not less than 2 $\mu$m and a part that is located closes to the other electrode and shows a surface roughness of not more than 0.5 $\mu$m. With this arrangement, the risk of inducing an electric discharge is minimized and, if an electric discharge occurs, the electrode is prevented from being destroyed by the discharge current because it has a part whose thickness is not less than 2 $\mu$m.

Preferably, the part of one of the electrodes located closest to the other electrode is projecting toward the other electrode.

More preferably, the one of the electrodes includes a first electroconductive member having a desired thickness and a second electroconductive member forming the part projecting toward the other electrode, the thickness of the first electroconductive member being greater than that of the second electroconductive member.

The high electric potential may be the electric potential adapted to accelerate electron beams, whereas the low electric potential may be the electric potential of the ground GND.

An image display apparatus according to the invention may further comprise a rear plate provided at least with an electron beam source and the one of the electrodes is arranged on the rear plate.

An image display apparatus according to the invention may further comprise a face plate provided at least with targets adapted to emit light in response to irradiation of electrons and the one of the electrodes is arranged on the face plate.

The electrode showing an electric potential defined to be low may be formed to entirely surround the electrode showing an electric potential defined to be high.

Preferably, an anti-static film is arranged on a surface located between the electrode showing an electric potential defined to be low and the electrode showing an electric potential defined to be high.

Since the insulating surface arranged between the oppositely disposed electrodes of known image display apparatus of the type under consideration generally provides a triple point located near an end of the electrodes where dielectric, metal and vacuum meet and is apt to become electrically charged, it can give rise to an electric discharge. Therefore, an anti-static film may be arranged on a surface located between the electrode showing an electric potential defined to be low and the electrode showing an electric potential defined to be high of an image display apparatus according to the invention in order to avoid such a problem.

Preferably, if the film thickness of the second electroconductive member is Ta and the film thickness of the first electroconductive member is Tb, they satisfy the requirement expressed by the formula of $$Tb>10\times Ta.$$

Preferably, if the distance from an edge of the second electroconductive member to the corresponding edge of the first electroconductive member is Da and the film thickness of the first electroconductive member is Tb, they satisfy the requirement expressed by the formula of $$Da>Tb.$$

When an image display apparatus according to the invention satisfies the above requirements, the electric field to which the thickest electroconductive member is subjected can effectively be weakened by the electric potential distribution produced by the relatively thin electroconductive member so that any electric discharge is prevented from taking place.

Preferably, the film thickness of the second electroconductive member is not more than 500 nm.

According to the invention, there is also provided an image display apparatus comprising an electrode showing an electric potential defined to be high and an electrode showing an electric potential defined to be lower than the high electric potential, the electrodes being arranged vis-à-vis, at least one of the electrodes showing a surface profile in a part thereof located closest to the other electrode smoother than the surface profile in the remaining part, the remaining part of the one of the electrodes having an area showing a thickness greater than the thickness of the part located closest to the other electrode.

Thus, an image display apparatus according to the invention comprises at least two parts that are responsible for different respective functions. More specifically, the part that is apt to give rise to an electric discharge because of a short distance separating the two electrodes is made relatively thin so that the electrodes may not show a complex profile and hence can effectively prevent an electric discharge from taking place. Additionally, if an electric discharge occurs, the relatively thick part of the electrodes is prevented from being destroyed.

According to the invention, there is also provided an image display apparatus comprising a substrate carrying on the same surface thereof an electrode showing an electric potential defined to be high, an electrode showing an electric potential defined to be lower than the high electric potential and a high resistance film arranged to bridge the electrodes, at least one of the electrodes having a portion being closest to the other of said electrodes, the portion being located on the surface of the substrate, and the portion being covered with the high resistance film, the thickness A of the part of the one of the electrodes covered by the high resistance film and the thickness B of the high resistance film satisfying the requirement expressed by the formula of $B<A<15B$.

With the above described arrangement, the high resistance film can effectively avoid a problem of defective coverage at the part thereof connecting the electrodes, while satisfactorily suppressing the power consumption rate, and at the same time the electrodes can have sufficient respective thicknesses that are sufficient for defining the respective electric potentials.

Preferably, the part of one of the electrodes located closest to the other electrode is projecting toward the other electrode.

More preferably, the one of the electrodes includes a first electroconductive member having a desired thickness and a second electroconductive member forming the part projecting toward the other electrode, the thickness of the first electroconductive member being greater than that of the second electroconductive member. Then, if an electric discharge inadvertently occurs, the electrodes are prevented from being destroyed.

DETAILED DESCRIPTION OF THE PREFERRED EMBODIMENTS

Now, the present invention will be described in greater detail by referring to the accompanying drawing that illustrates preferred embodiments of the invention. However, the specific dimensions, materials, profiles and relative positions of the components contained in the following description of the preferred embodiments are simply cited as examples and, unless noted otherwise, do not limit the scope of the invention.

(First Embodiment)

The first embodiment of image display apparatus according to the present invention will be described by referring to FIGS. 1A, 1B, 2A and 2B.

Figure 1A:
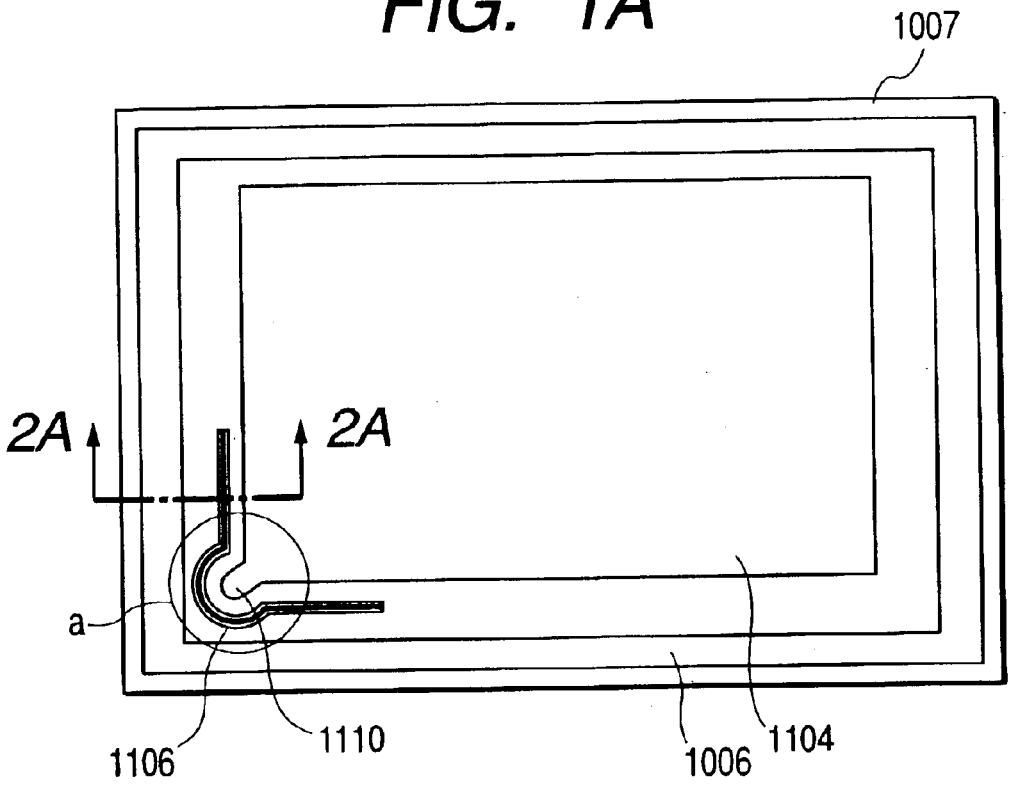
FIG. 1A is a schematic plan view of the first embodiment of image display apparatus according to the invention as viewed from the face plate side thereof.
Figure 1B:
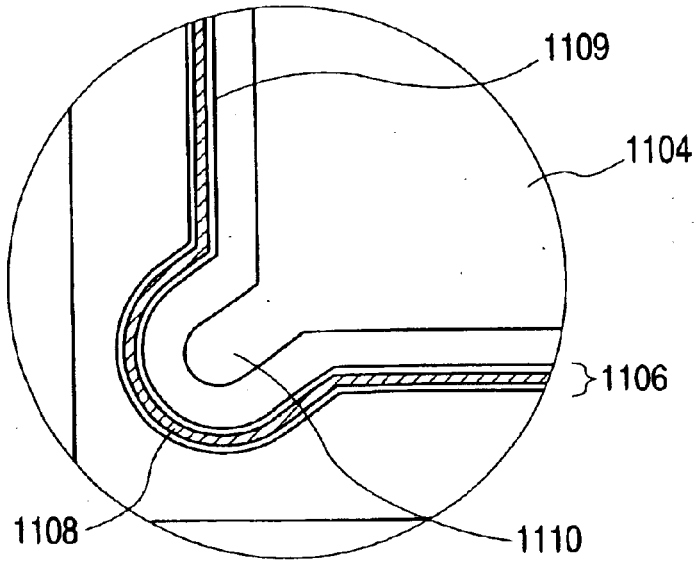
FIG. 1B is an enlarged schematic view of the encircled part of the embodiment of FIG. 1A.
Figure 2A:
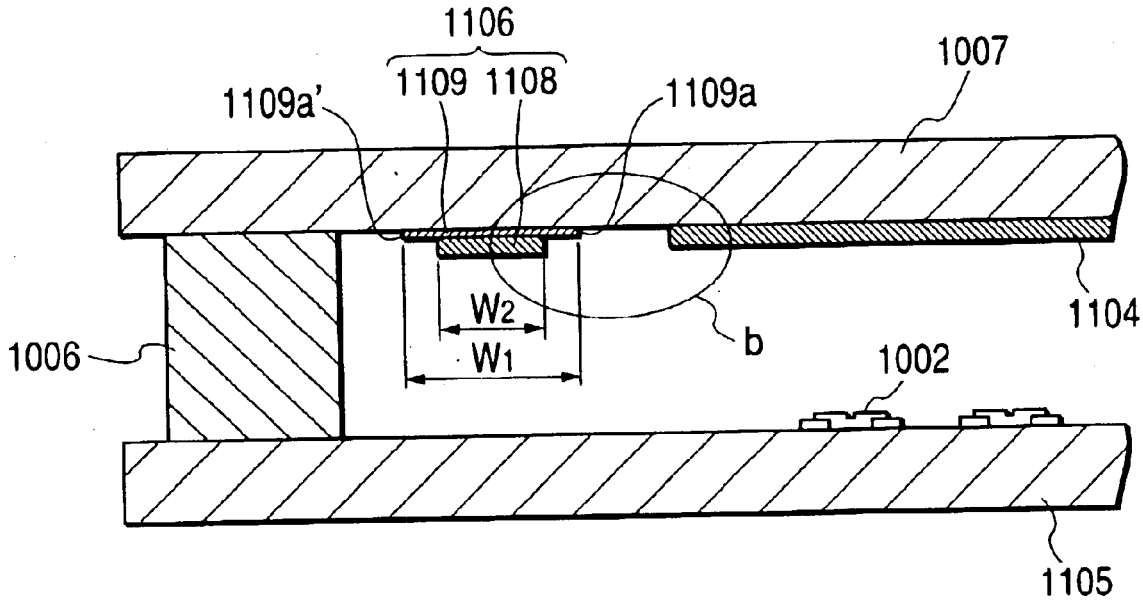
FIG. 2A is an enlarged schematic cross sectional view of the embodiment of FIG. 1A taken along line 2A—2A.
Figure 2B:
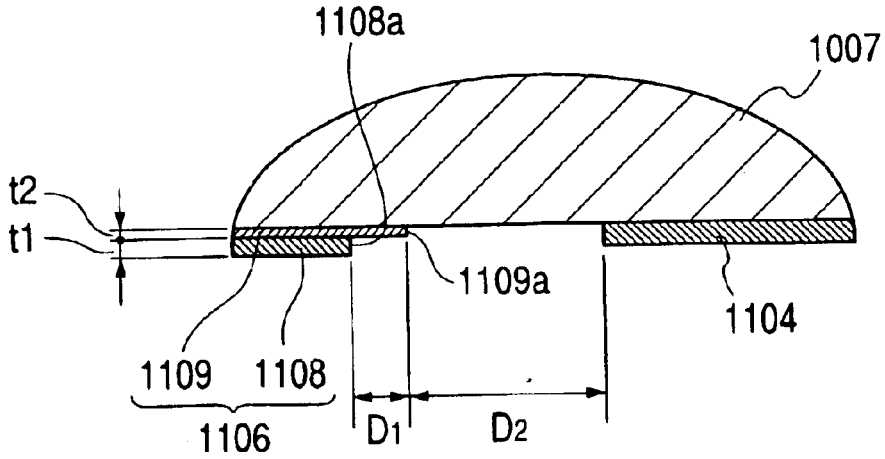
FIG. 2B is an enlarged schematic view of the encircled part of the embodiment of FIG. 2A.
Figure 3:
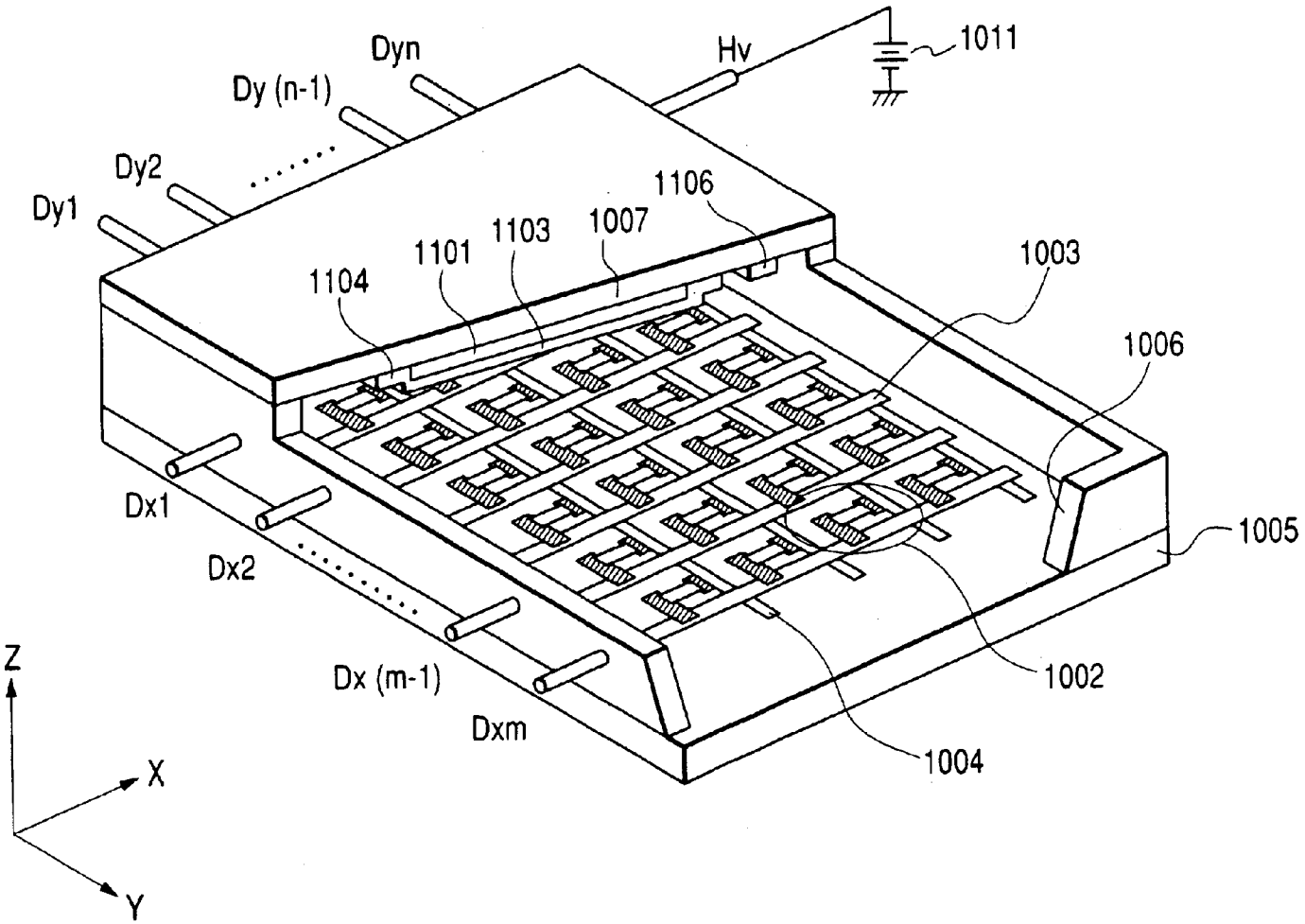
FIG. 3 is a partly cut away schematic perspective view of the display panel of an image display apparatus according to the invention.
Figure 4A:
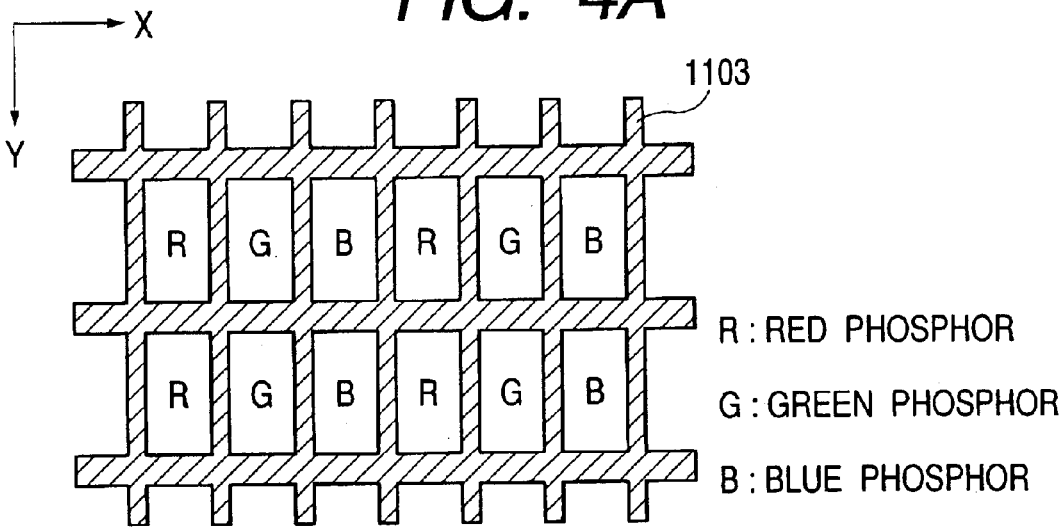
FIGS. 4A and 4B are schematic plan views of two different arrangements of phosphors that can be used for the face plate of the display panel of an image display apparatus according to the invention.
Figure 4B:
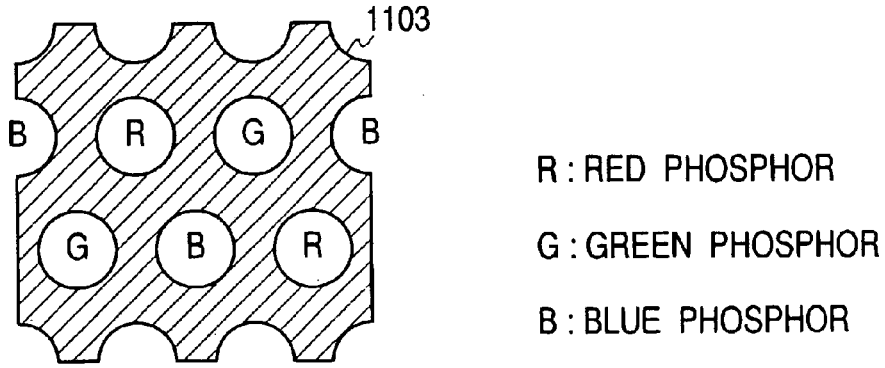

FIG. 1A is a schematic plan view of the first embodiment of image display apparatus according to the invention as viewed from the face plate side thereof and FIG. 1B is an enlarged schematic view of the encircled part of the embodiment of FIG. 1A, whereas FIG. 2A is an enlarged schematic cross sectional view of the embodiment of FIG. 1A taken along line 2A—2A and FIG. 2B is an enlarged schematic view of the encircled part of the embodiment of FIG. 2A. FIG. 3 is a partly cut away schematic perspective view of the display panel that is used in the first embodiment of image display apparatus according to the invention and FIGS. 4A and 4B are schematic plan views of two different arrangements of phosphors that can be used for the face plate of the display panel of an image display apparatus according to the invention, of which FIG. 4A shows a matrix arrangement of phosphors and FIG. 4B shows a delta arrangement of phosphors.

The face plate 1007 of the embodiment has an anode 1104 that includes an image display region. The anode 1104 is fed with an anode potential that is adapted to accelerate electron beams by way of a high voltage taking out section 1110. The high voltage taking out section 1110 is provided with a high voltage introducing terminal (not shown) and connected to a high voltage source 1101.

The high voltage taking out section 1110 is inevitably located close to the side wall (which may also be referred to as support frame) 1006 and hence an electric discharge can take place between itself and the side wall 1006. If the side wall 1006 and the face plate 1007 are bonded together by means of frit glass that can hardly be controlled for profile as will be described hereinafter, the high voltage taking out section 1110 can be made to show an undulated profile, which by turn can give rise to a concentrated electric field. A concentrated electric field can induce an electric discharge between the side wall 1006 and the high voltage taking out section 1110.

In this embodiment, an electric potential defining electrode 1106 having a structure adapted to define an electric potential is arranged between the side wall 1006 and the high voltage taking out section 1110 for the purpose of dissolving this problem. While any electric potential lower than that of the anode 1104 can achieve the above purpose, the electric potential of the ground, or GND, is selected here. The electric potential defining electrode 1106 has two electroconductive members that are laid one on the other as two layers. They include a second electroconductive member 1109 arranged on the face plate 1007 and having a thickness of t2 and a first electroconductive member 1108 arranged in the inside of the second electroconductive member 1109 as viewed from above and having a thickness of t1 which is greater than the thickness t2 of the second electroconductive member 1109. In other words, the electric potential defining electrode 1106 is formed by laying a first electroconductive member 1108 on a thin second electroconductive member 1109, wherein the first electroconductive member 1108 has a width W2 smaller than the width W1 of the second electroconductive member 1109 and a thickness greater than the thickness of the second electroconductive member 1109. The surface profile of the second electroconductive member is such that its surface roughness is not greater than 0.5 $\mu$m and hence its surface is smoother than that of the first electroconductive member. We confirmed by experiment that the second electroconductive member located close to the anode is formed to have a surface roughness not greater than 0.5 $\mu$m, to form smooth surface configuration enough to suppress an induce of an electric discharge. The first electroconductive member has a thickness of not less than 2 $\mu$m, preferably not less than 3 $\mu$m and is thicker than the second electroconductive member. With the above described arrangement, the distance between an edge 1108*a* of the first electroconductive member 1108 that is located close to the anode 1104 and the anode 1104 is defined to be equal to D1+D2 as shown in FIG. 2B, where D2 is the distance between the edge 1109*a* of the second electroconductive member 1109 that is located close to the anode 1104 and the anode 1104 and D1 is the distance between the edge 1108*a* and the edge 1109*a*, so that the second electroconductive member 1109 is closer to the anode 1104 than the first electroconductive member 1108.

Preferably, the thickness t1 of the first electroconductive member 1108 and the thickness t2 of the second electroconductive member 1109 satisfy the requirement expressed by the formula of $$t1>10\times t2.$$

Preferably, the distance D1 between the edge 1109*a* or the edge 1109*a*' of the second electroconductive member 1109 and the corresponding edge 1108*a* of the first electroconductive member 1108 and the thickness t2 of the second electroconductive member 1109 satisfy the requirement expressed by the formula of $$D1>t2.$$

As described above, in this embodiment, an electrode whose electric potential is defined to be high and an electric potential defining electrode 1106 having two electroconductive members laid one on the other as two layers and adapted to define a lower electric potential are arranged on the same plane and the first electroconductive member 1108 of the electric potential defining electrode 1106 is located inside the edges 1109*a*, 1109*a*' of the second electroconductive member 1109 as viewed from above. Since the edge 1109*a* that is apt to give rise to a concentrated electric field (and located closest to the high voltage taking out section 1110 that is arranged vis-à-vis and whose voltage is defined to be high) belongs to the second electroconductive member 1109 that can be prepared by way of a thin film process typically using a vacuum evaporation method or a sputtering method so as not to show any complex surface profile, it can be made very smooth and practically free from any electric discharge. If an electric discharge takes place, while the thin second electroconductive member 1109 may be destroyed, the first electroconductive member 1108 that is thicker than the second electroconductive member 1109 will be prevented from being destroyed and remain to protect the electric potential defining electrode 1106 against the problem of broken wire.

Now, the configuration and the method of preparing the display panel of this embodiment of image display apparatus will be described by referring to FIGS. 3, 4A and 4B.

The rear plate 1005, the side wall 1006 and the face plate 1007 form an airtight container that maintains the inside of the display panel in a vacuum state. Therefore, the junctions of the above components have to be made to maintain a sufficient degree of strength and airtightness when assembling the components. Typically, the airtight container is hermetically sealed by applying frit glass to the areas of the components that are to be bonded together and baking the assembled components in the ambient air or in a nitrogen atmosphere at 400 to 500° C. for 10 minutes or more. The method to be used for evacuating the inside of the airtight container to produce vacuum there will be described hereinafter.

A total of N×M surface conduction electron-emitting devices are formed on the rear plate 1005 (where N and M are integers not smaller than 2 and selected appropriately depending on the required number of display pixels). The N×M surface conduction electron-emitting devices are wired by M row-directional wirings 1003 and N column-directional wirings 1004 that are arranged to form a passive matrix. Thus, the multi-electron-beam source is formed by the surface conduction electron-emitting devices 1002, the row-directional wirings 1003 and the column-directional wirings 1004.

The inside of the airtight container is evacuated to produce vacuum there by connecting the exhaust pipe (not shown) and a vacuum pump after assembling the airtight container and evacuating the inside of the airtight container to a degree of vacuum of about $10^{-5}$ [Pa]. Subsequently the exhaust pipe is hermetically sealed and a getter film (not shown) is formed at a predetermined position in the inside of the airtight container immediately before or after the operation of sealing the airtight container. A getter film is formed by heating and evaporating a getter material typically containing Ba as principal ingredient by means of a heater or a high frequency heating device. The inside of the airtight container is maintained to a degree of vacuum between $1\times10^{-3}$ and $1\times10^{-5}$ [Pa] due to the adsorption effect of the getter film.

Now, the multi-electron-beam source used in the display panel will be described below.

Any multi-electron-beam source may be used in an image display apparatus according to the invention so long as it is prepared by arranging cold cathode devices in the form of a passive matrix or a ladder and the material and the profile of the cold cathode devices are not subjected to any particular limitations. In other words, cold cathode devices that can be used for the purpose of the invention include surface conduction electron-emitting devices and field emission type (to be referred to as FE type hereinafter) and metal/insulating layer/metal type (to be referred to as MIM type hereinafter) cold cathode devices.

However, the use of surface conduction electron-emitting devices is particularly advantageous if compared with other cold cathode devices under the circumstances where low cost display apparatus having a large display screen meet the demand of the market. More specifically, FE type cold cathode devices require the use of high precision manufacturing technologies because the electron-emitting performance of an FE type cold cathode device largely depends on the relative position and the profiles of the emitter cone and the gate electrode, which represents a disadvantageous aspect of such devices from the viewpoint of providing a large display screen and reducing the manufacturing cost. On the other hand, MIM type cold cathode devices require the use of an insulating layer and an upper electrode that have a small and uniform thickness, which also represents a disadvantageous aspect from the viewpoint of providing a large display screen and reducing the manufacturing cost. Unlike these devices, surface conduction electron-emitting devices can be manufactured by way of a relatively simple manufacturing process and hence they are suited for providing a large display screen and reducing the manufacturing cost. The inventors of the present invention have found that surface conduction electron-emitting devices having an electron-emitting region and a peripheral region thereof that are formed from a micro-particle film are particularly excellent in terms of electron-emitting performance and can be manufactured with ease. Therefore, the use of such surface conduction electron-emitting devices is very suitable for the multi-electron-beam source of an image display apparatus having a large display screen and adapted to show bright images. From this point of view, surface conduction electron-emitting devices having an electron-emitting region and a peripheral region thereof that are formed from a micro-particle film are used for the display panel of this embodiment (the method of preparing the multi-electron-beam source is omitted here).

Now, the configuration and the method of preparing the face plate of the display panel will be described below by way of a specific example.

Materials that can be used for the substrate 1101 of the face plate 1007 include soda lime glass, glass containing impurities such as Na to a reduced extent and glass containing one or more than one alkali earth metals and showing an enhanced level of electric insulation (e. g., PD200, tradename, available from Asahi Glass Co., Ltd.).

After cleaning and drying the substrate 1101, the second electroconductive member 1109 of the electric potential defining electrode 1106 was prepared by way of a vacuum evaporation process. Any material that shows a sufficiently low electric resistance and hence can be used to define an electric potential may be employed for the electric potential defining electrode 1106. Materials that can be used for the electric potential defining electrode 1106 include metals such as Ni, Cr, Au, Mo, W, Pt, Ti, Al, Cu and Pd, alloys of any of them, transparent conductors such as $In_2O_3$—$SnO_2$ and semiconductors such as polysilicon. Preferably, the second electroconductive member 1109 has a thickness not more than 500 nm depending on the material selected for it. For example, it preferably has a thickness of 100 nm, although the thickness of the second electroconductive member 1109 is not limited thereto.

Thereafter, the anode 1104 that included a black matrix 1103 as shown in FIG. 4A and the high voltage taking out section 1110 were prepared by way of a screen printing process, using glass paste and paste containing a black pigment and silver particles. At the same time, the first electroconductive member 1108 of the electric potential defining electrode 1106 was formed in such a way that it is found inside the second electroconductive member 1109 as shown in FIG. 2A. While, preferably, the anode 1104, the high voltage taking out section 1110 and the second electroconductive member 1109 have a thickness of 10 $\mu$m, their thicknesses are not limited thereto.

The distance D1 from an edge of the second electroconductive member 1109 to the corresponding edge of the first electroconductive member 1108 meets the related requirement of the present invention if it is not less than a certain value (generally not less than 0.01 mm). For example, the distance D2 between the anode 1104 and the second electroconductive member 1109 may be D2=6.0 mm and the distance D1 from an edge of the second electroconductive member 1109 to the corresponding edge of the first electroconductive member 1108 may be D1=0.2 mm from the viewpoint that the surface area of the image display panel other than the image display area is preferably minimized, although other values may be selected for the distances D1 and D2.

The black matrix 1103 is provided for the purpose of preventing the different colors of the phosphors from mixing, avoiding color breakups if electron beams are misaligned slightly, absorbing external light, improving the contrast of the displayed image and so on. While a black matrix was prepared by way of a screen printing process in the above example for this embodiment, the present invention is by no means limited thereto and some other process such as a photolithography process may alternatively be used. Additionally, while glass paste and paste containing a black pigment and silver particles were used as materials of the black matrix 1103 in the above example, the present invention is by no means limited thereto and carbon black may alternatively be used. The black matrix 1103 of this embodiment shown in FIG. 4A may be replaced by a member showing a delta arrangement as shown in FIG. 4B or a stripe arrangement (not shown).

A phosphor film may be formed in each of the openings of the black matrix 1103 by way of a screen printing process, using phosphor pastes of red, blue and green, or by way of a photolithography process. While P22 phosphors including red phosphor (P22-RE3; $Y_2O_2S$; Eu3+), blue phosphor (P22-B2; ZnS: Ag, Al) and green phosphor (P22-GN4; ZnS: Cu, Al) that are widely used in the field of CRTs may also suitably be used here, the present invention is by no means limited thereto and other phosphors may alternatively be used for the purpose of the invention.

Then, a resin intermediate film was prepared by way of a filming process that is well known in the field of Braun tubes and subsequently a metal evaporation film (Al evaporation film in this embodiment) was prepared. Finally, a metal back was formed by removing the resin intermediate layer by thermal decomposition.

The anode 1104 of the face plate 1007 prepared in a manner as described above was then connected to the high voltage source 1011. The electric potential defining electrode 1106 was connected to the GND.

In this embodiment of image display apparatus having a configuration as described above, the electric potential defining electrode 1106 formed by arranging a first electroconductive member 1108 having a thickness not less than 2 $\mu$m, preferably not less than 3 $\mu$m, in the inside of a smooth and thin second electroconductive member 1109 showing a surface roughness of not more than 0.5 $\mu$m is arranged as a low potential side electrode on the plane where the electrode whose electric potential is defined to be high is also arranged. With this arrangement, an electric discharge can hardly take place because the edge 1109*a* of the second electroconductive member 1109 of the electric potential defining electrode 1106 where a concentrated electric field can appear is made relatively thin and smooth. As a result, the image display apparatus is protected against degradation of image quality that can be caused by electric discharges.

If an electric discharge takes place, the relatively thin second electroconductive member 1109 may be destroyed. However, the relatively thick first electroconductive member 1108 remains undestroyed due to its thickness so that the electric potential defining electrode 1106 is protected against the problem of broken wire to consequently improve the reliability of the image display apparatus.

(Second Embodiment)

Now, the second embodiment of image display apparatus according to the present invention will be described by referring to FIGS. 5 and 6.

Since this embodiment of image display apparatus is similar to the first embodiment as a whole, only the characteristic parts of the second embodiment will be described below. In FIGS. 5 and 6, the components that are the same as or similar to those of the first embodiment are denoted respectively by the same reference symbols.

Figure 5:
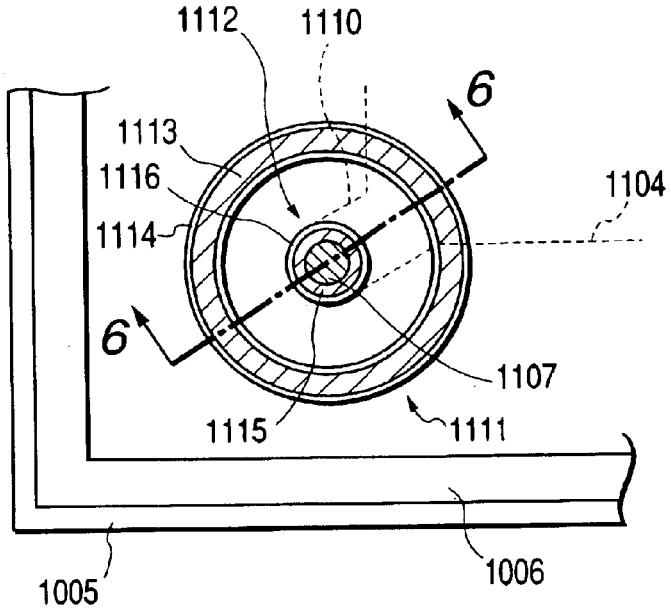
FIG. 5 is a schematic plan view of the second embodiment of image display apparatus according to the invention, showing the rear plate high voltage introducing section thereof.
Figure 6:
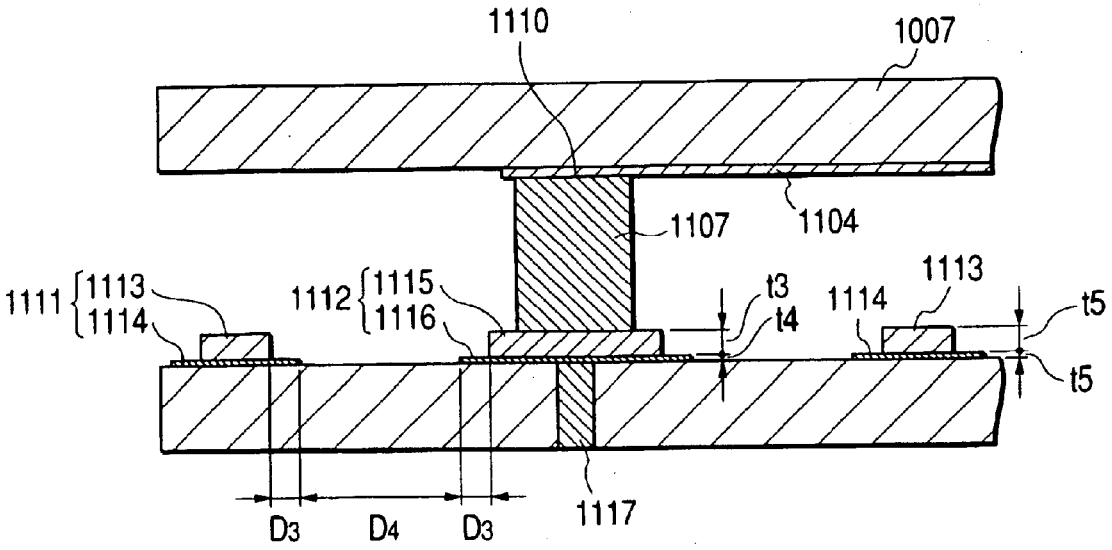
FIG. 6 is a schematic cross sectional view of the embodiment of FIG. 5 taken along line 6—6.

FIG. 5 is a schematic plan view of the second embodiment of image display apparatus according to the invention, showing the rear plate high voltage introducing section thereof and FIG. 6 is a schematic cross sectional view of the embodiment of FIG. 5 taken along line 6—6.

In FIG. 5, the broken line shows the anode 1104 and the high voltage taking out section 1110 that are located at the side of the face plate 1007 disposed vis-à-vis the rear plate 1005.

The rear plate 1005 has a high voltage introducing section including a high voltage introducing terminal 1117, a high voltage defining electrode 1112 (including a first electrode 1115 and a second electrode 1116 as shown in FIG. 6) and a high voltage supply terminal 1107.

The high voltage introducing terminal 1117 is adapted to feed the high voltage defining electrode 1112 with the anode potential from the high voltage source 1011 and also electrically feed the high voltage taking out section 1110 and the anode 1104 on the face plate 1007 by way of the high voltage supply terminal 1107. With this arrangement, electric potential of the high voltage taking out section 1110 and that of the anode 1104 are defined to be equal to the anode potential. As described above by referring to the first embodiment, it is difficult to make the side wall 1006 practically free from undulations and hence the side wall 1006 can give rise to an electric discharge with a high probability. Therefore, a GND defining electrode 1111 (formed by a first electroconductive member 1113 and a second electroconductive member 1114 as shown in FIG. 6) is provided at the high voltage introducing section of the rear plate 1005 in order to prevent an electric discharge from taking place between the high voltage defining electrode 1112 and the side wall 1006.

The high voltage defining electrode 1112 has a second electrode 1116 showing a surface roughness of not more than 0.5 $\mu$m and a thickness of t4 and a first electrode 1115 arranged inside the second electrode 1116 as viewed from above and having a thickness of t3 that is not less than 2 $\mu$m, preferably not less than 3 $\mu$m, and greater than the thickness of the second electrode 1116. The GND defining electrode 1111 also has a second electroconductive member 1114 showing a surface roughness of not more than 0.5 $\mu$m and a thickness of t6 and a first electroconductive member 1113 arranged inside the second electroconductive member 1114 as viewed from above and having a thickness of t5 that is not less than 2 $\mu$m, preferably not less than 3 $\mu$m, and greater than the thickness of the second electroconductive member 1114.

Preferably, the thickness t3 of the first electrode 1115 and the thickness t4 of the second electrode 1116 satisfy the requirement expressed by the formula of $t3>10\times t4$.

Preferably, the thickness t5 of the first electroconductive member 1113 and the thickness t6 of the second electroconductive member 1114 satisfy the requirement expressed by the formula of $t5>10\times t6$.

Preferably, the distance D3 between the first electrode 1115 and the second electrode 1116 and the thickness t3 of the first electrode 1116 satisfy the requirement expressed by the formula of $D3>t3$ and the distance D3 from an edge of the second electroconductive member 1114 to the corresponding edge of the first electroconductive member 1113 and the thickness t5 of the first electroconductive member 1113 satisfy the requirement expressed by the formula of $D3>t5$.

In FIG. 6, the distance between the edge of the first electroconductive member 1113 located close to the high voltage defining electrode 1112 and the latter is expressed by D3+D4, where D4 is the distance between the edge of the second electroconductive member 1114 located close to the high voltage defining electrode 1112 and the latter. Thus, the second electroconductive member 1114 is located closer to the high voltage defining electrode 1112 than the first electroconductive member 1113.

Since the high voltage defining electrode 1112 and the GND defining electrode 1111 are formed by using two different electroconductive members that are laid one on the other as two layers and have different respective thicknesses. With this arrangement, an electric discharge can hardly take place because the edge of each of the electrodes where a concentrated electric field can appear is made relatively thin and smooth with a surface roughness of not more than 0.5 $\mu$m as in the case of the first embodiment. As a result, an electric discharge can hardly occur in the image display apparatus and, if it occurs, the image display apparatus is protected against the problem of broken wire.

Preferably, a high resistance film (also referred to as anti-static film hereinafter) is provided on the glass surface (to be also referred to as creeping surface) between the high voltage defining electrode 1112 and the GND defining electrode 1111 so that any electric discharge is reliably prevented from taking place between the high voltage defining electrode 1112 and the GND defining electrode 1111. If such is the case, it is preferable that at least either the high voltage defining electrode 1112 or the GND defining electrode 1111 has a relatively thick electrode member (electroconductive member) arranged on a relatively thin electrode member (electroconductive member) so as to be included in the latter and the thickness A of the thin electrode member and the thickness B of the high resistance film satisfy the requirement expressed by the formula of $B<A<15B$. With this arrangement, the high resistance film can cover the thin electrode without giving rise to a problem of defective coverage and the power consumption rate of the high resistance film can be minimized. Additionally, the electric potentials of the electrodes can be defined reliably and the electrodes are prevented from being destroyed if an inadvertent electric discharge occurs.

Now, the anti-discharge film will be described below.

If the creeping surface between the high voltage defining electrode 1112 and the GND defining electrode 1111 on the rear plate 1005 is realized by a glass surface (dielectric), there appears a spot where dielectric, metal and vacuum meet, and a concentrated electric field occurs there. Additionally, the surface becomes electrically charged and the accumulated electric charge will be eventually discharged. An anti-static film is arranged on the glass surface of this embodiment of image display apparatus in order to avoid the above problems. The intensity of the electric current that is made to flow to the anti-static film is defined by the value obtained by dividing the voltage between the anode potential applied to the high voltage defining electrode 1112 and the electric potential of the GND defining electrode 1111 (anode voltage: Va) by the resistance Rs of the anti-static film. Therefore, the resistance Rs of the anti-static film is defined to be within a desirable range that is determined on the basis of anti-static effect and power consumption rate. From the viewpoint of anti-static effect, the surface resistance R of the anti-static film is preferably not more than $R=10^{16}$ [Ω/□] because a concentrated electric field can occur and the electric charge can become significantly influential when the resistance is too high. More preferably, the surface resistance R of the anti-static film is not more than $R=10^{14}$ [Ω/□] for the purpose of providing a satisfactory anti-static effect. Preferably, the surface resistance R of the anti-static film is not less than $R=10^{7}$ [Ω/□] because the power consumption rate rises when the surface resistance R is too low, although the lower limit of the surface resistance R depends on the contour of the glass surface where the anti-static film is formed and the voltage that is applied between the electrodes.

The material of the anti-static film may be selected from metal oxides. Metal oxides that can be used for the anti-static film include oxides of chromium, nickel and copper because such oxides shows a relatively low secondary electron emitting efficiency and hence can hardly be charged with electricity. Beside metal oxides, preferable materials that show a low secondary electron emitting efficiency also include carbon.

Materials that can be used for the anti-static film also include nitrides of alloys of germanium and transition metals because the electric resistance of such a nitride can be controlled over a wide range by regulating the content of transition metal so that the nitride can be made to be a good conductor of electricity or an electric insulator. Additionally, the electric resistance of such a nitride stably remains at a constant level through the entire process of manufacturing the display apparatus. Transition metals that can be used for the anti-static film include Ti, V, Cr, Mn, Fe, Co, Ni, Cu, Zr, Nb, Mo, Hf and W.

A film of nitride of an alloy can be formed on an insulator by way of a thin film forming process such as sputtering, reactive sputtering conducted in a nitrogen gas atmosphere, electron beam evaporation, ion plating or ion assist evaporation. In this embodiment, oxygen gas is used in place of nitrogen gas. A metal oxide film can be formed by means of CVD or alkoxide application. When a carbon film is used, techniques such as evaporation, sputtering, CVD and plasma CVD may be used. For preparing amorphous carbon, the film forming atmosphere is made to contain hydrogen or hydrocarbon gas is used as film forming gas.

Now, the configuration and the method of preparing the high voltage introducing section of the rear plate will be described below by way of a specific example.

The second electroconductive member 1114 of the GND defining electrode 1111 and the second electrode 1116 of the high voltage defining electrode 1112 that are relatively thin were prepared by sputtering. While the materials listed in the description of the first embodiment may be used also for them, the second electroconductive member 1114 and the second electrode 1116 were prepared by forming a low resistance film of Ti and Pt by sputtering in this example. Subsequently, the first electroconductive member 1113 of the GND defining electrode 1111 and the second electrode 1115 of the high voltage defining electrode 1112 that are relatively thick as shown in FIGS. 5 and 6 were prepared by using glass paste and paste that contains silver particles by screen printing.

In this example, nitride of germanium and tungsten prepared by sputtering was used as anti-static film.

Like the first embodiment, in the embodiment of image display apparatus having the above described configuration, the high voltage defining electrode 1112 is formed by arranging a first electrode 1115 having a thickness t3 of not less than 2 μm, preferably not less than 3 μm, in the inside of a second electrode 1116 showing a surface roughness of not more than 0.5 μm and a thickness of t4 as viewed from above while the GND defining electrode 1111 is formed by arranging a first electroconductive member 1113 having a thickness t5 of not less than 2 μm, preferably not less than 3 μm, in the inside of a second electroconductive member 1114 showing a surface roughness of not more than 0.5 μm and a thickness of t6 as viewed from above. With this arrangement, an electric discharge can hardly take place because the edge of the second electrode and that of the second electroconductive member where a concentrated electric field can appear is made relatively thin and smooth with a level of surface roughness of not more than 0.5 μm. As a result, the image display apparatus is protected against degradation of image quality that can be caused by electric discharges.

If an electric discharge takes place, the second electrode 1116 of the high voltage defining electrode 1112 and the second electroconductive member 1114 of the GND defining electrode 1111 that are relatively thin may be destroyed. However, the first electrode 1115 and the first electroconductive member 1113 that are relatively thick remain undestroyed due to their thicknesses so that the high voltage defining electrode 1112 and the GND defining electrode 1111 are protected against the problem of broken wire to consequently improve the reliability of the image display apparatus.

(Third Embodiment)

Now, the third embodiment of image display apparatus according to the present invention will be described by referring to FIGS. 7A, 7B, 8A and 8B.

Since this embodiment of image display apparatus is similar to the first embodiment as a whole, only the characteristic parts of the second embodiment will be described below. In FIGS. 7A, 7B, 8A and 8B, the components that are same as or similar to those of the first embodiment are denoted respectively by the same reference symbols.

Figure 7A:
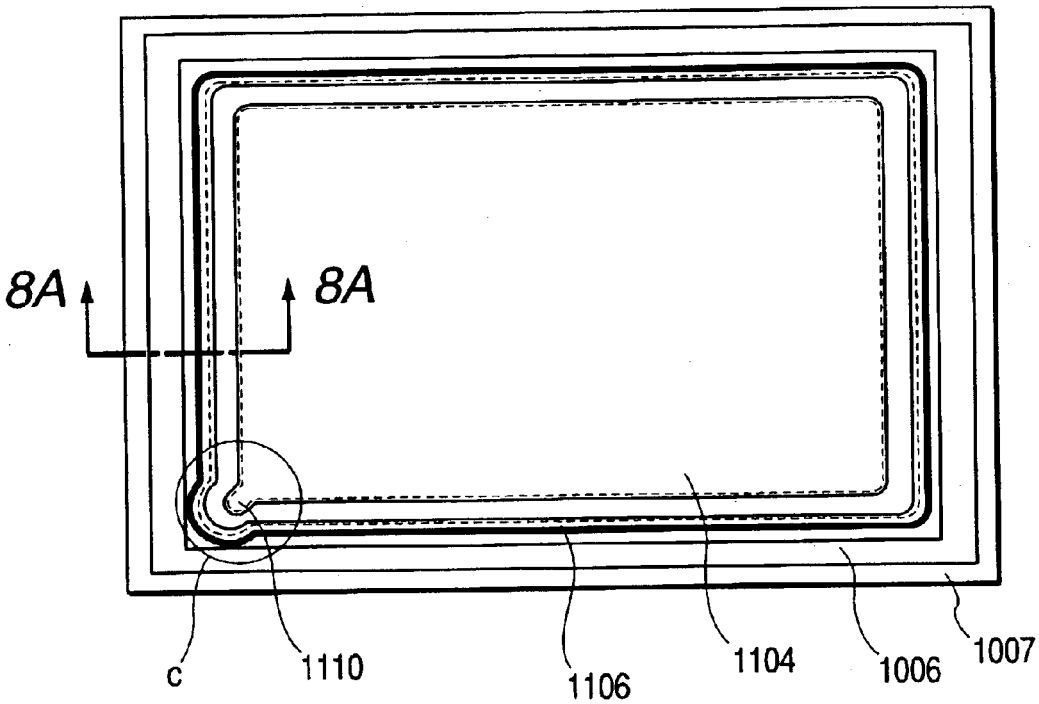
FIG. 7A is a schematic plan view of the third embodiment of image display apparatus according to the invention as viewed from the face plate side thereof.
Figure 7B:
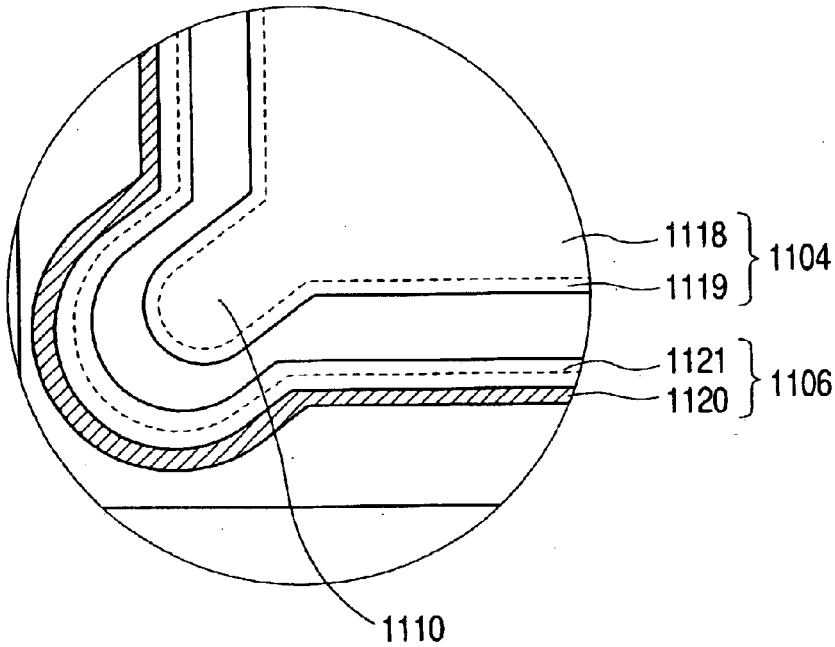
FIG. 7B is an enlarged schematic view of the encircled part of the embodiment of FIG. 7A.
Figure 8A:
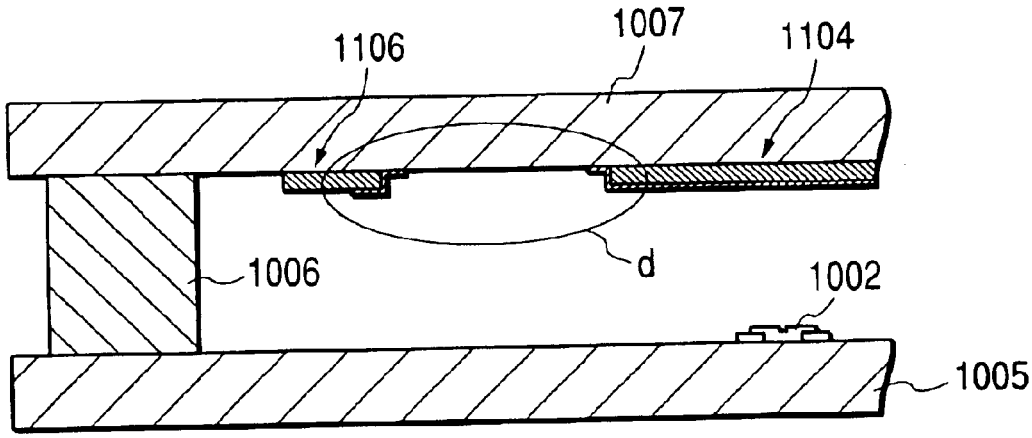
FIG. 8A is an enlarged schematic cross sectional view of the embodiment of FIG. 7A taken along line 8A—8A.
Figure 8B:
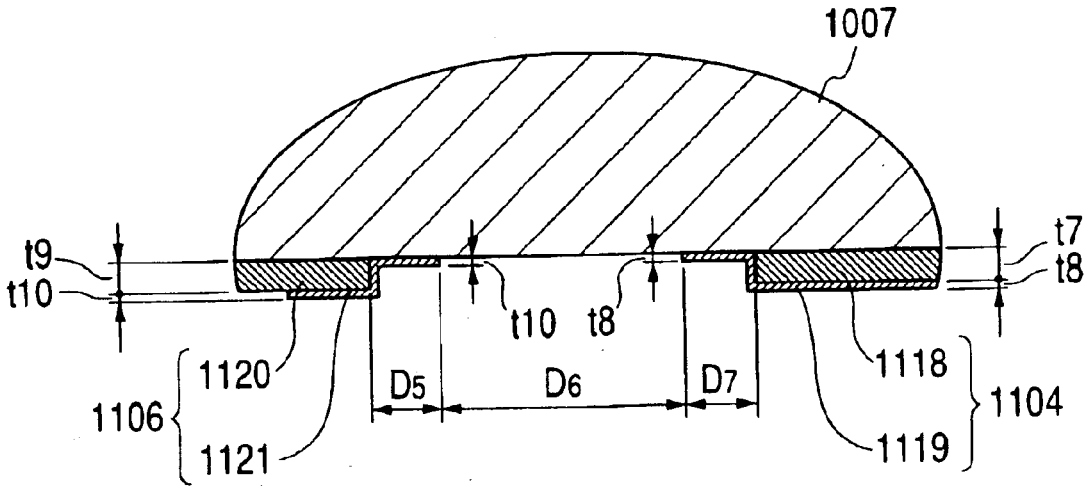
FIG. 8B is an enlarged schematic view of the encircled part of the embodiment of FIG. 8A.
Figure 9:
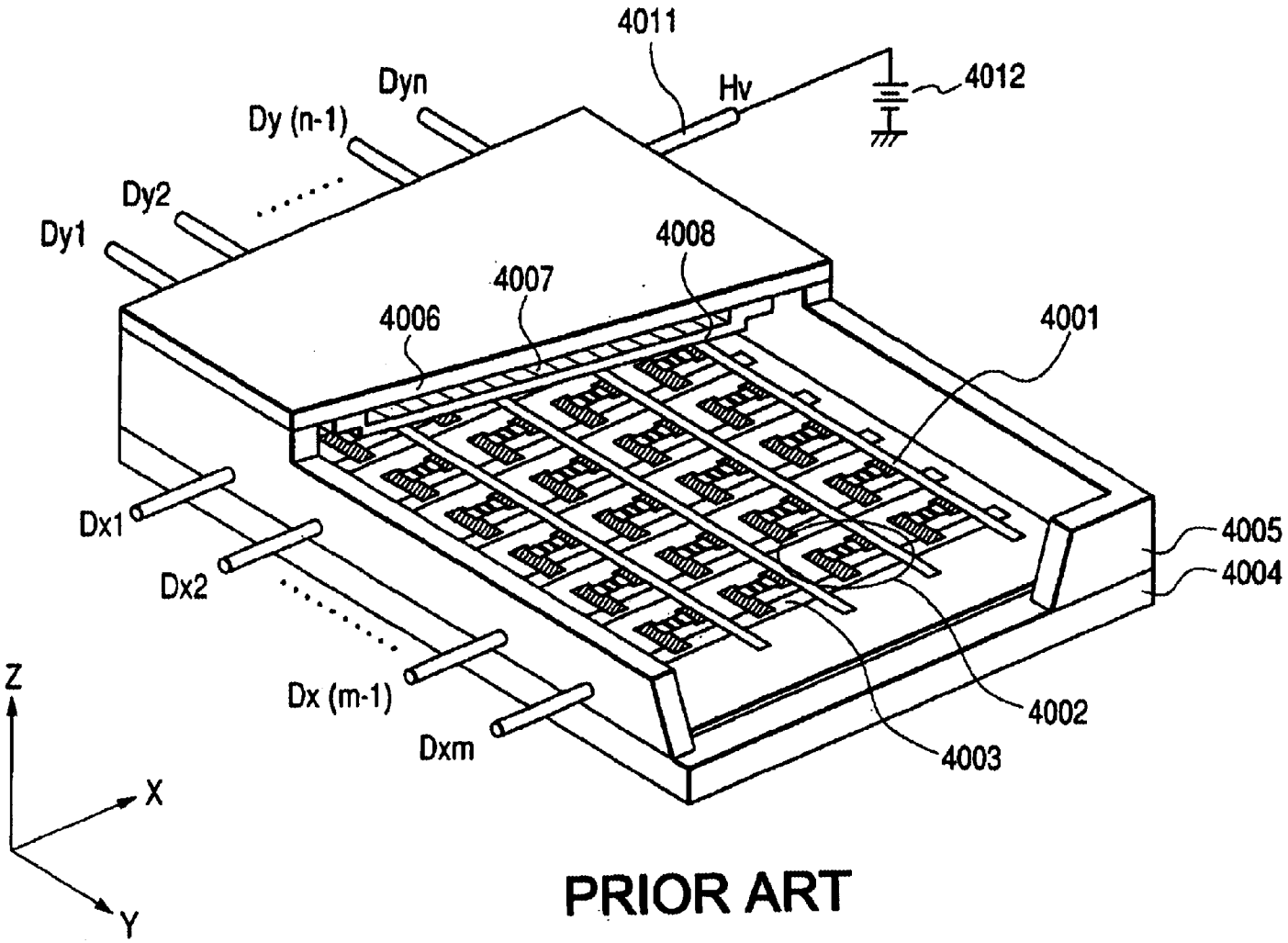
FIG. 9 is a partly cut away schematic perspective view of the display panel of a known image display apparatus.
Figure 10:
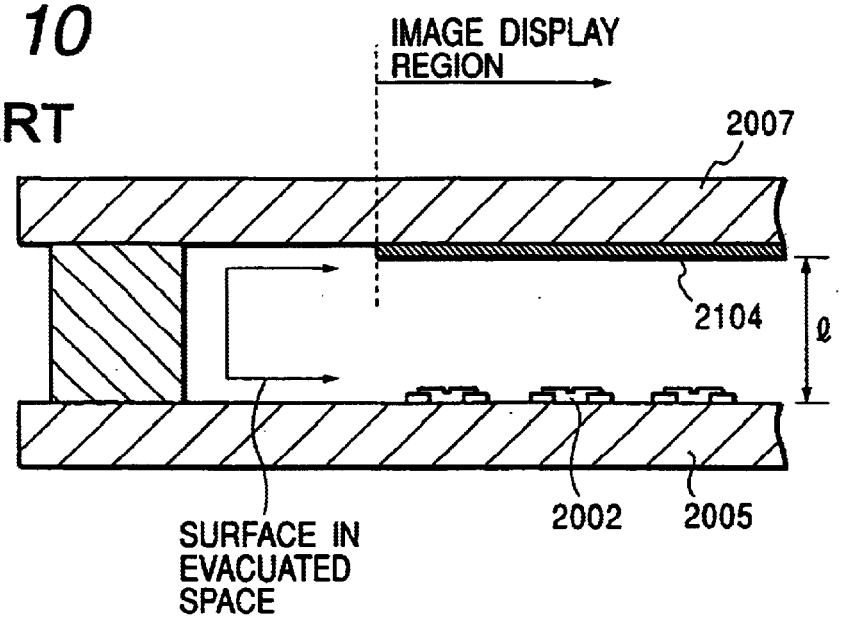
FIG. 10 PRIOR ART
FIG. 10 is a schematic cross sectional view of a peripheral part of the anode of a known image display panel.
Figure 11:
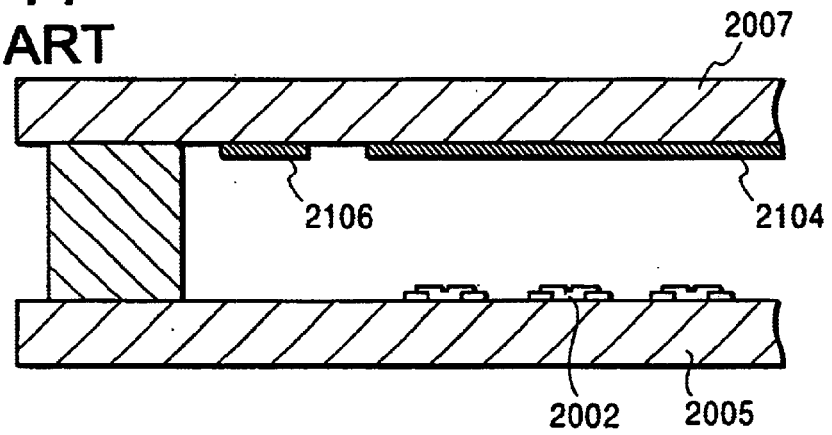
FIG. 11 PRIOR ART
FIG. 11 is a schematic cross sectional view of a known image display panel comprising an electric potential defining electrode located at a peripheral position of the anode.
Figure 12:
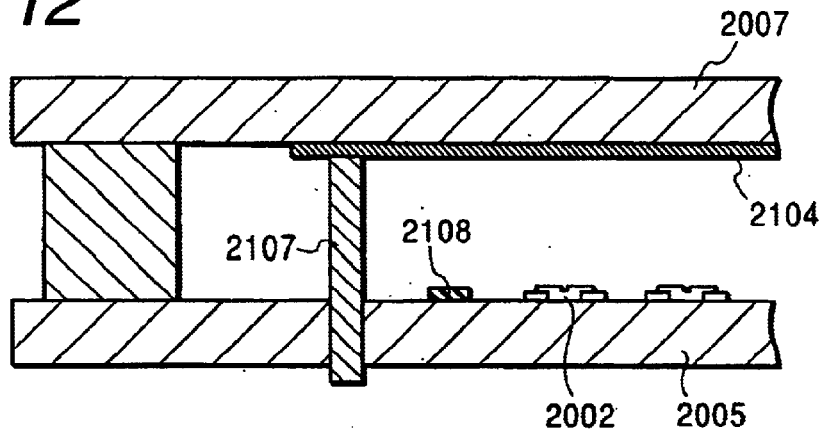
FIG. 12 PRIOR ART
FIG. 12 is a schematic cross sectional view of a known image display panel comprising a high voltage introducing terminal located at the rear plate side.

FIG. 7A is a schematic plan view of the third embodiment of image display apparatus according to the invention as viewed from the face plate side thereof and FIG. 7B is an enlarged schematic view of the encircled part of the embodiment of FIG. 7A, whereas FIG. 8A is an enlarged schematic cross sectional view of the embodiment of FIG. 7A taken along line 8A—8A and FIG. 8B is an enlarged schematic view of the encircled part of the embodiment of FIG. 8A.

The face plate 1007 has an anode 1104 that includes an image display region and an anode potential is supplied to the anode 1104 by way of the high voltage taking out section 1110. The high voltage taking out section 1110 is provided with a high voltage introducing terminal (not shown) at the side of the face plate 1007 and connected to a high voltage source 1011. An electric potential defining electrode 1106 whose electric potential is defined to be equal to GND is arranged around the anode 1104 and the high voltage taking out section 1110 of the face plate 1007 on the face plate 1007 in order to prevent an electric discharge from taking place between the side wall 1006 and the anode 1104 or the high voltage taking out section 1110. Both the anode 1104 and the electric potential defining electrode 1106 have two electroconductive members that are laid one on the other as two layers. The two electroconductive members of the anode 1104 include a second electroconductive member 1119 showing a surface roughness of not more than 0.5μ, and a thickness of t8 and a first electroconductive member 1118 having a thickness t7 of not less than 2 μm, preferably not less than 3 μm, and substantially covered by the second electroconductive member 1119. Similarly, the two electroconductive members of the electric potential defining electrode 1106 include a second electroconductive member 1121 showing a surface roughness of not more than 0.5 μm, and a thickness of t10 and a first electroconductive member 1120 having a thickness t9 of not less than 2 μm, preferably not less than 3 μm, and covered by the second electroconductive member 1121 only at the side of the anode 1104.

Thus, the anode 1104 has a thin region with a thickness of t8 and a thick region with a thickness of t7+t8, while the electric potential defining electrode 1106 also has thin region with a thickness of t10 and a thick region with a thickness of t9+t10, and the thin region of the anode 1104 with the thickness of t8 and the thin region of the electric potential defining electrode 1106 with the thickness of t10 are located closest to each other and disposed vis-à-vis.

It will be appreciated that, while a relatively thick electroconductive member or electrode is formed on a relatively thin electroconductive member or electrode, whichever appropriate, in the first and second embodiment, a relatively thin electroconductive member or electrode is formed on a relatively thick electroconductive member or electrode, whichever appropriate, on the third embodiment.

Preferably, the thickness t7 of the first electrode 1118 and the thickness t8 of the second electrode 1119 satisfy the requirement expressed by the formula of $$t7>10\times t8.$$

Preferably, the thickness t9 of the first electroconductive member 1120 and the thickness t10 of the second electroconductive member 1121 satisfy the requirement expressed by the formula of $$t9>10\times t10.$$

Preferably, the distance D7 between the second electrode 1119 and the first electrode 1118 and the thickness t7 of the first electrode 1118 satisfies the requirement expressed by the formula of $$D7>t7.$$

Preferably, the distance D5 between an edge of the second electroconductive member 1121 and the corresponding edge of the first electroconductive member 1120 and the thickness t9 of the first electroconductive member 1120 satisfies the requirement expressed by the formula of $$D5>t9.$$

While the arrangement of first electrode and the second electrode and that of the first electroconductive member and the second electroconductive member are inverse relative to the corresponding arrangements of the first and second embodiments, the edge of the electrode and that of the electroconductive member where a concentrated electric field can easily occur are made smooth to show a surface roughness of not more than 0.5 μm. As a result, the image display apparatus is protected against degradation of image quality that can be caused by electric discharges.

If an electric discharge takes place in this embodiment, the second electrode 1119 having the thickness of t8 of the anode 1104 and the second electroconductive member 1121 having the thickness of t10 of the electric potential defining electrode 1106 may be destroyed. However, the first electrode 1118 having the thickness of t7 of the anode 1104 and the first electroconductive member 1120 having the thickness of t9 of the electric potential defining electrode 1106 remain undestroyed due to their thicknesses so that the anode 1104 and the electric potential defining electrode 1106 are protected against the problem of broken wire to consequently improve the reliability of the image display apparatus. Additionally, it is desirably that at least either the second electroconductive member or the second electrode that is thin is covered, if partly, with an anti-static film (high resistance film) as in the case of the second embodiment. Then, the thickness A of the thin electrode (or electroconductive member) and the thickness B of the high resistance film preferably satisfy the requirement expressed by the formula of B<A<15B. With this arrangement, the high resistance film can cover the thin electrode without giving rise to a problem of defective coverage and the power consumption rate of the high resistance film can be minimized. Additionally, the electric potentials of the electrodes can be defined reliably and the electrodes are prevented from being destroyed if an inadvertent electric discharge occurs.

It should be noted here that two electroconductive members and/or two electrode having different thicknesses are used in each of the above embodiments, the present invention is by no means limited thereto. In other words, more than two electroconductive members and/or electrodes having different thicknesses may be combined for use. Alternatively, a similar effect may be obtained by using a single electroconductive member and forming a part having a differentiated profile or controlling the surface roughness thereof.

Any two or more than two of the above described embodiments may be combined.

EXAMPLES

Now, the present invention will be described further by way of examples, although the present invention is by no means limited by the examples.

First Example

In this example, an image display apparatus having the configuration of the first embodiment was driven to operate and observed to see if an electric discharge occurs and, if an electric discharge occurs, a problem of broken wire occurs or not.

The face plate 1007 of the image display apparatus was prepared by using PD200, tradename, available from Asahi Glass Co., Ltd.

A phosphor film was formed in each of the openings of the black matrix 1103 by way of a screen printing process, using phosphor pastes of red, blue and green, in three steps where phosphor paste of a single color is employed at a time. P22 phosphors including red phosphor (P22-RES; Y2O2S; Eu3+), blue phosphor (P22-B2; ZnS:Ag, Al) and green phosphor (P22-GN4; ZnS:Cu, Al) that are widely used in the field of CRTs were used here.

Then, a resin intermediate film was prepared by way of a filming process and subsequently an Al evaporation film was prepared. Finally, a 100 nm thick metal back was prepared by removing the resin intermediate film by thermal decomposition.

A total of N×M surface conduction electron-emitting devices 1002 were formed on the rear plate 1005. (N=1440, M=480)

Note that an image display apparatus having the above described configuration was also used in Example 2 and Example 3, which will be described hereinafter.

In this example, the second electroconductive member 1109 of the electric potential defining electrode 1106 was formed by way of a vacuum evaporation process, using Al as material. The second electroconductive member 1109 was made to show a thickness of 100 nm. When the surface of the second electroconductive member 1109 was observed by stylus-based surface profiler, it was found that the surface roughness was 0.04 μm.

The anode 1104 and the high voltage taking out section 1110 were prepared by way of a screen printing process, using glass paste and paste containing a black pigment and silver particles. They were made to show a thickness of 10 μm. At the same time, the first electroconductive member 1108 of the electric potential defining electrode 1106 was formed in such a way that it was found inside the second electroconductive member 1109 as shown in FIGS. 2A and 2B. It showed a thickness of 10 μm.

The distance between the anode 1104 and the second electroconductive member 1109 was made equal to D2=6.0 mm and the distance from an edge of the second electroconductive member 1109 to the corresponding edge of the first electroconductive member 1108 was made equal to D1=0.2 mm.

When the image display apparatus having the above described configuration was driven to operate by applying an anode voltage of Va=10 kV. No electric discharge was observed and the apparatus operated well. When the anode voltage Va was forced to rise, an electric discharge was observed at Va=18 kV. Thereafter, the apparatus was driven to operate again by applying an anode voltage of Va=10 kV and no electric discharge was observed. Subsequently, the image display panel was disassembled and the high voltage taking out section 1110 of the face plate 1007 was observed to find that the first electroconductive member 1108 remained undestroyed and no broken wire had occurred to the electric potential defining electrode 1106, although the second electroconductive member 1109 of the electric potential defining electrode 1106 had been destroyed. Although not used in this example, it is preferable to provide a high resistance film between the anode and the electric potential defining electrode for the purpose of achieving an anti-static effect. Then, the withstand voltage of the face plate 1107 is improved and an electric discharge is prevented more reliably from taking place. The high resistance film is preferably made to have a thickness between about 0.01 μm and about 1.5 μm in order to prevent a problem of defective coverage of the high resistance film relative to the second electroconductive member from occurring and reduce the rise in the power consumption rate that is attributable to the provision of the high resistance film.

Second Example

In this example, an image display apparatus having the configuration of the second embodiment was driven to operate and observed to see if an electric discharge occurs and, if an electric discharge occurs, a problem of broken wire occurs or not.

In this example, the second electrode 1116 of the high voltage defining electrode 1112 and the second electroconductive member 1114 of the GND defining electrode 1111 were formed by means of a low resistance film made of Ti (underlayer; 20 nm) and Pt (80 nm) by sputtering. Both the surface roughness of the second electrode 1116 and that of the second electroconductive member 1114 were 0.03 μm when observed by means of a contact needle type surface roughness meter.

Both the first electrode 1115 of the high voltage defining electrode 1112 and the first electroconductive member 1113 of the GND defining electrode 1111 were prepared to a thickness of 5 μm by screen printing, using glass paste and paste containing silver particles.

The distance between the high voltage defining electrode 1112 and the GND defining electrode 1111 was made equal to D4=4.0 mm and both the distance from an edge of the relatively thin electroconductive member 1114 to the corresponding edge of the relatively thick electroconductive member 1113 and the distance from an edge of the relatively thin electrode 1116 to the corresponding edge of the relatively thick electrode 1115 were made equal to D3=0.1 mm.

Figure 13:
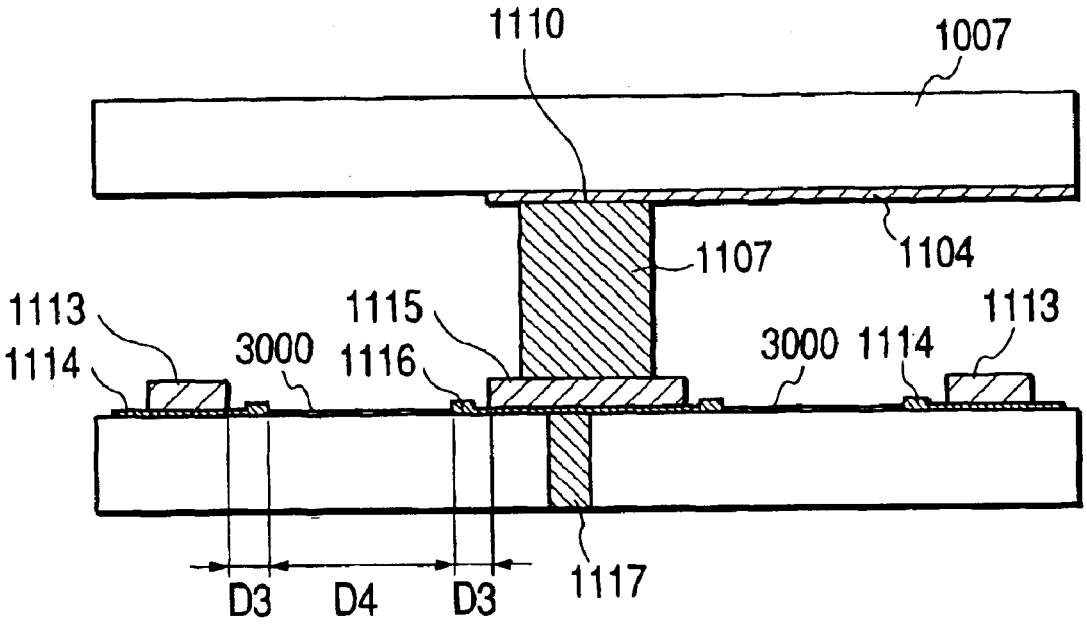
FIG. 13 is an enlarged schematic partial view of the image display apparatus prepared in Example 2.

An anti-static film 3000 was formed between the second electroconductive member 1114 and the second electrode 1116 to partly cover the second electroconductive member 1114 and the second electrode 1116 as shown in FIG. 13. The anti-static film was formed by using germanium and nitride of tungsten prepared by sputtering. The surface resistance of the anti-static film was observed to find that it was found to be equal to $Rs=2\times10^{11}$ [Ω/□]. The film thickness was 10 nm.

Otherwise, the image display apparatus of this example was identical with that of the first example.

When the image display apparatus having the above described configuration was driven to operate by applying an anode voltage of Va=10 kV. No electric discharge was observed and the apparatus operated well. When the anode voltage Va was forced to rise, an electric discharge was observed at Va=20 kV. Thereafter, the apparatus was driven to operate again by applying an anode voltage of Va=10 kV and no electric discharge was observed. Subsequently, the image display panel was disassembled and the high voltage taking out section 1110 of the rear plate 1005 was observed to find that the first electrode 1115 remained undestroyed and no broken wire had occurred to the high voltage defining electrode 1112, although the second electrode 1116 of the high voltage defining electrode 1112 had been destroyed. Likewise, the first electroconductive member 1113 of the GND defining electrode 1111 remained undestroyed and no broken wire had occurred to the GND defining electrode 1111, although the second electroconductive member 1114 had been destroyed.

Third Example

In this example, an image display apparatus having the configuration of the third embodiment was driven to operate and observed to see if an electric discharge occurs and, if an electric discharge occurs, a problem of broken wire occurs or not.

The face plate of the image display apparatus used in this example was prepared in a manner as described below.

Firstly, the first electrode 1118 of the anode 1104 was prepared to a thickness of 5 μm by screen printing, using glass paste and paste containing a black pigment and silver particles. The first electrode 1118 operated also as black matrix and had a profile as shown in FIG. 4A. It was formed inside the second electrode 1119, which was prepared subsequently. At the same time, the first electroconductive member 1120 of the electric potential defining electrode 1106 was formed so as to completely surround the anode 1104 to a thickness of 5 μm, which was equal to the thickness of the anode 1104.

Then, a phosphor film was formed in the image region and subsequently a resin intermediate film was prepared by way of a filming process. Thereafter, an Al film was formed by evaporation to produce a metal back in the image display region so as to completely cover the first electrode 1118 of the anode 1104 as shown in FIGS. 8A and 8B. At the same, the second electrode 1119 was formed in a position located at an end of the anode 1104 and outside the image display region. Simultaneously, the second electroconductive member 1121 of the electric potential defining electrode 1106 was formed. A patterning operation was conducted by using a metal mask for forming the electric potential defining electrode 1106. The related dimensions were as follows. Referring to FIG. 8B, the gap separating the second electrode 1119 of the anode 1104 and the second electroconductive member 1121 of the electric potential defining electrode 1106 was equal to D6=4.0 mm, the distance from an edge of the first electrode 1118 to the corresponding edge of the second electrode 1119 of the anode 1104 was equal to D7=0.3 mm, while the distance from an edge of the first electroconductive member 1120 to the corresponding edge of the second electroconductive member 1121 of the electric potential defining electrode 1106 was equal to D5=0.3 mm. The thickness of the second electrode and that of the second electroconductive member were made equal to T8=T10=0.3 μm. Both the surface roughness of the second electroconductive member and that of the second electrode were 0.1 μm.

Otherwise, the image display apparatus of this example was identical with that of the first example.

Figure 14:
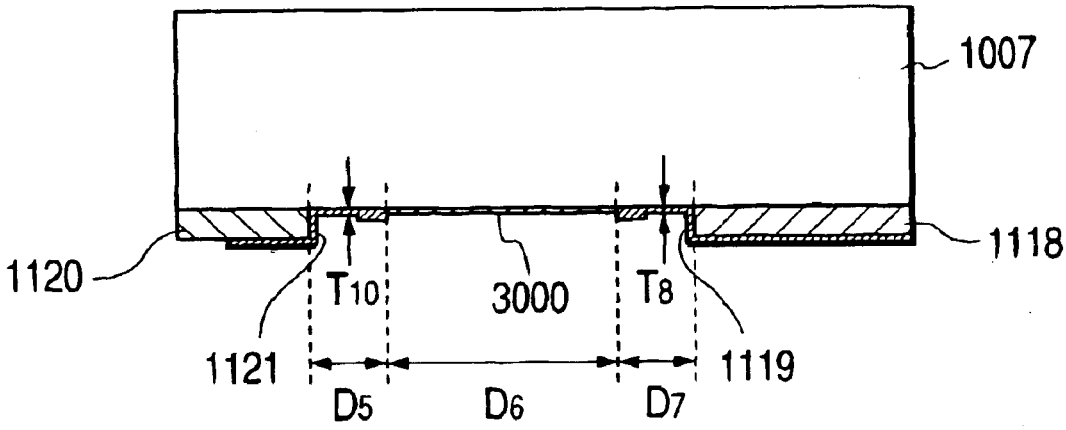
FIG. 14 is a partially enlarged schematic view of the image display apparatus prepared in Example 3.

A film containing dispersed graphite particles to an appropriate concentration was prepared by way of a spraying process and used as an anti-static film 3000, which was arranged between the anode 1104 and the electric potential defining electrode 1106. The surface resistance of the anti-static film was observed to find that it was found to be equal to $Rs=5\times10^{14}$ [Ω/□]. FIG. 14 shows a partially enlarged schematic view of the image display apparatus prepared in Example 3.

When the image display apparatus having the above described configuration was driven to operate by applying an anode voltage of Va=10 kV. No electric discharge was observed and the apparatus operated well. When the anode voltage Va was forced to rise, an electric discharge was observed at Va=23 kV. Thereafter, the apparatus was driven to operate again by applying an anode voltage of Va=10 kV and no electric discharge was observed. Subsequently, the image display panel was disassembled and the anode 1104 and the electric potential defining electrode 1106 of the face plate 1007 were observed to find that the first electrode 1118 of the anode 1104 and the first electroconductive member 1120 of the electric potential defining electrode 1106 remained undestroyed and no broken wire had occurred to them, although the second electrode 1119 of the anode 1104 and the second electroconductive member 1121 of the electric potential defining electrode 1106 had been destroyed.

(Meritorious Effects of the Invention)

As described above, in an image display apparatus according to the invention, a smooth electroconductive member showing a surface roughness of not more than 0.5 μm is used for an electrode in an area where an electric discharge can easily occur because of a short distance separating the electrode and some other electrode in addition to another thick electroconductive member for the purpose of preventing an electric discharge from taking place and protecting the electrode from being destroyed by a discharge current. Further, even if an electric occurs, the electrode is prevented from being destroyed because relatively thick conductive members having a thickness of not less than 2 μm, preferably not less than 3 μm are used. With this arrangement, if an electrode whose electric potential is defined to be high and an electrode whose electric potential is defined to be lower coexist on the same plane in the image display apparatus, the probability of occurrence of electric discharge is remarkably reduced. If an electric discharge occurs, the electrode is protected against broken wire and the problem that a high voltage is applied after the electric discharge is avoided to improve the reliability of the image display apparatus.

In an image display apparatus according to the invention that comprises an electrode showing an electric potential defined to be high and an electrode showing an electric potential defined to be lower than the high electric potential and in which a high resistance film is arranged to cover the part of one of the electrode located closest to the other electrode on the substrate, the high resistance film satisfactorily covers the said one of the electrode without giving rise to a problem of defective coverage and the increase in the power consumption rate due to the high resistance film is minimized when the thickness A of the part of said one of the electrodes covered by the high resistance film and the thickness B of the high resistance film satisfy the requirement expressed by the formula of $B<A<15B$. Additionally, the electric potentials of the electrodes are accurately defined and the electrodes are prevented from being destroyed if an electric discharge inadvertently occurs so that the image display apparatus can reliably display a fine image.

What is claimed is:

1. An image display apparatus comprising an electrode showing an electric potential defined to be high and an electrode showing an electric potential defined to be lower than said high electric potential, said electrodes being arranged in opposition to each other on the same plane, at least one of said electrodes having a part showing a thickness of not less than 2 μm and a part located closest to the other electrode and showing a surface roughness of not more than 0.5 μm.

2. The apparatus according to claim 1, wherein said part of one of the electrodes located closest to the other electrode is projecting toward said other electrode.

3. The apparatus according to claim 2, wherein said one of the electrodes includes a first electroconductive member having a desired thickness and a second electroconductive member forming the part projecting toward said other electrode, the thickness of the first electroconductive member being greater than that of the second electroconductive member.

4. The apparatus according to claim 1, wherein said high electric potential is the electric potential adapted to accelerate electron beams.

5. The apparatus according to claim 1, wherein said low electric potential is the electric potential of the ground GND.

6. The apparatus according to claim 1, further comprising:

a rear plate provided at least with an electron beam source;

said one of the electrodes being arranged on said rear plate.

7. The apparatus according to claim 1, further comprising:

a face plate provided at least with targets adapted to emit light in response to irradiation of electrons;

said one of the electrodes being arranged on said face plate.

8. The apparatus according to claim 1, wherein said electrode showing an electric potential defined to be low is formed to entirely surround said electrode showing an electric potential defined to be high.

9. The apparatus according to claim 1, wherein an anti-static film is arranged on a surface located between said electrode showing an electric potential defined to be low and said electrode showing an electric potential defined to be high in order to prevent an electric discharge from taking place.

10. The apparatus according to claim 3, wherein if the film thickness of said second electroconductive member is Ta and the film thickness of said first electroconductive member is Tb, they satisfy the requirement expressed by the formula of $$Tb>10\times Ta.$$

11. The apparatus according to claim 3, wherein if the distance from an edge of said second electroconductive member to the corresponding edge of said first electroconductive member is Da and the film thickness of said first electroconductive member is Tb, they satisfy the requirement expressed by the formula of $$Da>Tb.$$

12. The apparatus according to claim 3, wherein said film thickness of said second electroconductive member is not more than 500 nm.

13. An image display apparatus comprising an electrode showing an electric potential defined to be high and an electrode showing an electric potential defined to be lower than said high electric potential, said electrodes being arranged vis-à-vis, at least one of said electrodes showing a surface profile in a part thereof located closest to said other electrode smoother than the surface profile in the remaining part, said remaining part of said one of the electrodes having an area showing a thickness greater than the thickness of the part located closest to said other electrode.

14. An image display apparatus comprising a substrate carrying on a same surface thereof an electrode showing an electric potential defined to be high, an electrode showing an electric potential defined to be lower than said high electric potential and a high resistance film arranged to bridge the electrodes, at least one of said electrodes having a portion being closest to the other of said electrodes, the portion being located on the surface of said substrate, and the portion being covered with said high resistance film, the thickness A of said part of said one of the electrodes covered by said high resistance film and the thickness B of said high resistance film satisfying the requirement expressed by the formula of $B<A<15B$.

15. The apparatus according to claim 14, wherein said part of one of the electrodes located closest to the other electrode is projecting toward said other electrode.

16. The apparatus according to claim 15, wherein said one of the electrodes includes a first electroconductive member having a desired thickness and a second electroconductive member forming the part projecting toward said other electrode, the thickness of the first electroconductive member being greater than that of the second electroconductive member.

* * * * *

UNITED STATES PATENT AND TRADEMARK OFFICE

CERTIFICATE OF CORRECTION

PATENT NO. : 6,856,097 B2
DATED : February 15, 2005
INVENTOR(S) : Onishi

It is certified that error appears in the above-identified patent and that said Letters Patent is hereby corrected as shown below:

Column 1,
Line 11, “and being” should read -- and are being --.

Column 4,
Line 39, “closes” should read -- closest --.

Column 8,
Line 21, “induce” should read -- induction --.

Column 14,
Line 34, “shows” should read -- show --.

Column 16,
Line 13, “0.5µ,” should read -- 0.5µm, --;
Line 39, “on” should read -- in --; and
Lines 54 and 61, “satisfies” should read -- satisfy --.

Column 17,
Line 21, “desirably” should read -- desirable --; and
Line 36, “electrode” should read -- electrodes --.

Column 18,
Line 9, “plate 1005.” should read -- plate 1005 --; and
Line 10, “M=480)” should read -- M=480). --.

Column 20,
Line 47, “Va=10 kV. No” should read -- Va=10 kV, no --.

UNITED STATES PATENT AND TRADEMARK OFFICE

CERTIFICATE OF CORRECTION

PATENT NO. : 6,856,097 B2
DATED : February 15, 2005
INVENTOR(S) : Onishi

It is certified that error appears in the above-identified patent and that said Letters Patent is hereby corrected as shown below:

Column 21,
Line 4, "electric occurs," should read -- electric discharge occurs, --; and
Lines 20 and 22, "electrode" should read -- electrodes --.

Signed and Sealed this

Twenty-first Day of March, 2006

JON W. DUDAS
*Director of the United States Patent and Trademark Office*